United States Patent [19]

Tolbert

[11] Patent Number: 4,987,618

[45] Date of Patent: Jan. 29, 1991

[54] HAIR RINSING DEVICE

[76] Inventor: Linda D. Tolbert, #7 Londonberry Square, Cayce, S.C. 29033

[21] Appl. No.: 459,202

[22] Filed: Dec. 29, 1989

[51] Int. Cl.[5] ..... A45D 19/00

[52] U.S. Cl. ..... 4/515; 132/212

[58] Field of Search ..... 4/515–519; 132/212, 270

[56] References Cited

U.S. PATENT DOCUMENTS

| | | | |
|---|---|---|---|
| 998,804 | 7/1911 | Salisburg | 132/212 X |
| 2,507,386 | 5/1950 | Spiegel | 132/212 |
| 2,781,764 | 2/1957 | Miller | 132/212 |
| 2,812,519 | 11/1957 | Parks | 4/518 |
| 2,856,918 | 10/1958 | Kingery et al. | 4/517 X |
| 2,914,066 | 11/1959 | Gow | 4/518 X |
| 3,177,868 | 4/1965 | Wallace et al. | 4/517 |
| 3,456,655 | 7/1969 | Hale | 132/212 |
| 3,746,015 | 7/1973 | Schulman | 132/212 |
| 4,078,557 | 3/1978 | Spencer | 4/517 |
| 4,817,218 | 4/1989 | Dimitria et al. | 4/515 |

*Primary Examiner*—Charles E. Phillips
*Attorney, Agent, or Firm*—Leon Gilden

[57] ABSTRACT

A hair rinsing device is set forth utilizing an inner flexible cover securable about its perimeter to an outer flexible cover. The outer flexible cover includes an inlet hose and an outlet hose enabling directing of rinsing fluid through a matrix of apertures formed in the inner cover. Fluid valving is arranged for optional directing and mixing of cold and heated water from a plurality of sources.

8 Claims, 4 Drawing Sheets

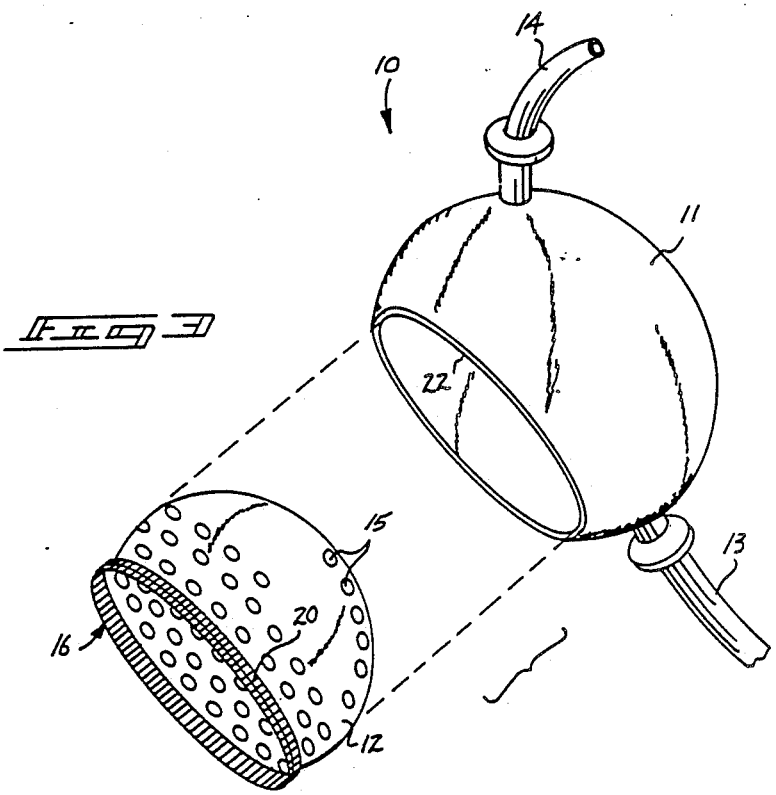
FIG 3
FIG 4
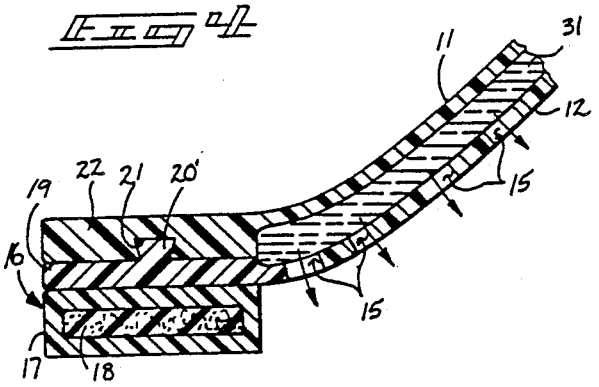

HAIR RINSING DEVICE

BACKGROUND OF THE INVENTION

1. Field of the Invention

The field of invention relates to hair rinsing apparatus, and more particularly pertains to a new and improved hair rinsing device wherein the same enables securement about an individual's hairline and directing of rinsing fluid interiorly of the device and onto an individual's hair for effective rinsing of the hair.

. 2. Description of the Prior Art

The use of various devices for the care of hair during and subsequent to a shampooing procedure have been developed in the prior art. Heretofore, the devices have failed to provide an encompassing hair rinsing apparatus wherein the same is available to enable a thorough rinsing of an individual's hair subsequent to a shampooing procedure. The devices of the prior art have been of an awkward and expansive organization, as opposed to the instant invention, to effect a directing of a fluid onto hair of an individual. For example. U.S. Pat. No. 2,916,917 illustrates the use of a hair spray shield wherein a helmet type organization is loosely fit over an individual to enable directing of a fluid spray from a variety of portals about the surface of the device. The device is of a remote organization relative to the Instant InventIon In that the helmet like covering for an individual fails to provide a sealing relationship with an individual's hairline and merely provides for a shielding compartment to maintain a level of fluid directed of the hair interiorly thereof.

U.S. Pat. No. 1,933,765 to Schallock provides for a hair covering sheath utilizing a plurality of straps to secure the sheath about an individual's head, but fails to provide any fluid directing conduits therein and serves as a guard for hair and the like of an individual.

U.S. Pat. No. 2,706,861 to Schmeer provides for a fabric-like covering overlying a hair with arcuate recess formed interiorly of an edge prior to wrapping of the covering about an individual to permit the positioning of a hair drying hose interiorly of the device.

U.S. Pat. No. 3,390,689 to Newman provides for a covering formed with apertures overlying the hair to enable the pulling of various hair portions therethrough to enable the treating of those individual portions of hair, such as in a bleaching operation and the like.

U.S. Pat. No. 3,416,517 to Adams provides for a helmet-like covering overlying a hair portion of an individual's head to enable the directing of various fluid and the like thereto and provides for a complex inter-relationship of linkages and conduits interiorly of the helmet covering providing a complex organization relatively remote from the organization set forth by the instant invention.

As such, it may be appreciated that there is a continuing need for a new and improved hair rinsing device wherein the same addresses both the problems of ease of use and effectiveness in construction, and in this respect the present invention substantially fulfills this need.

SUMMARY OF THE INVENTION

In view of the foregoing disadvantages inherent in the known types of hair rinsing apparatus now present in the prior art, the present invention provides a hair rinsing device wherein the same provides for a plurality of separable, flexible arcuate coverings securable together to provide for a fluid chamber therebetween to enable direction of fluid onto a hair portion of an individual's head. As such, the general purpose of the present invention, which will he described subsequently in greater detail, is to provide a new and improved hair rinsing device which has all the advantages of the prior art hair rinsing apparatus and none of the disadvantages.

To attain this, &he present invention includes a continuous elastomeric flexible cover formed with a matrix of through-extending apertures therethrough and an elastomeric rim including an elongate tongue member securable to a complementary groove member formed at the opening perimeter of an overlying flexible outer covering. The outer covering includes an inlet hose and an outlet hose to enable the directing of fluid interiorly of the covers within a chamber defined between inner and outer covers with an outlet hose to enable removal of excess fluid therefrom. A plurality of valving is provided to limit the inflow fluid to the device and further includes plural inlet hoses securable to a plurality of fluid sources to enable the mixing as desired of hot and cold water utilized in a rinsing procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determIne quickly from a cursory inspection the nature and essence o( the technical disclosure of the application. The abstract is neither intended to define the invention of the application, which is measured by the claims. nor is it intended to e limiting as to the scope of the invention in any way.

It is therefore an object of the present invention to provide a new and Improved hair rinsing device which has all the advantages of the prior art hair rinsing apparatus and none of the disadvantages.

It is another object of the present invention to provide a new and improved hair rinsing device which may be easily and efficiently manufactured and marketed.

It is a further object of the present invention to provide a new and improved hair rinsing device which is of a durable and reliable construction.

An even further object of the present invention is to provide a new and improved hair rinsing device which is susceptible of a low cost of manufacture with regard to both materials and labor, and which accordingly is then susceptible of low prices of sale to the consuming public, thereby making such hair rinsing device economically available to the buying public.

Still yet another object of the present invention is to provide a new and improved hair rinsing device which provides in the apparatuses and methods of the prior art some of the advantages &hereof, while simultaneously overcoming some of the disadvantages normally asSociated therewith.

Still another object of the present invention is to provide a new and improved hair rinsing device wherein the same is formed with flexible inner and outer covers securable about an individual to enable the directing of a rinsing fluid about an individual's hair and enable removal of excess fluid therefrom during a hair rinsing procedure.

These together with other objects of the invention. along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference t the annexed drawings wherein:

FIG. 3 is an isometric illustration of the instant invention in an exploded view.

FIG. 4 is an orthographic cross-sectional view of the securement perimeters of the inner and outer flexible covers of the instant invention.

FIG. 7 is an isometric illustration of the inlet hose utilized by the instant invention.

DESCRIPTION OF THE PREFERRED EMBODIMENT

Figure 1:
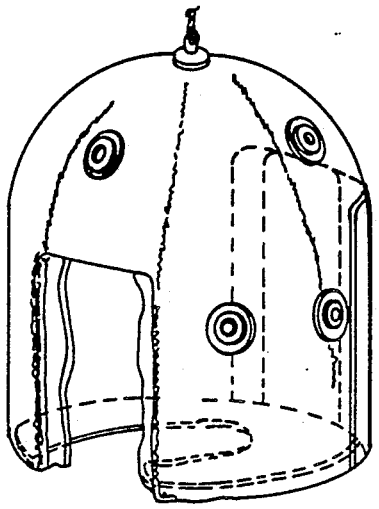
Fig 1 PRIOR ART
FIG. 1 is an isometric illustration of a typical prior art device.
Figure 2:
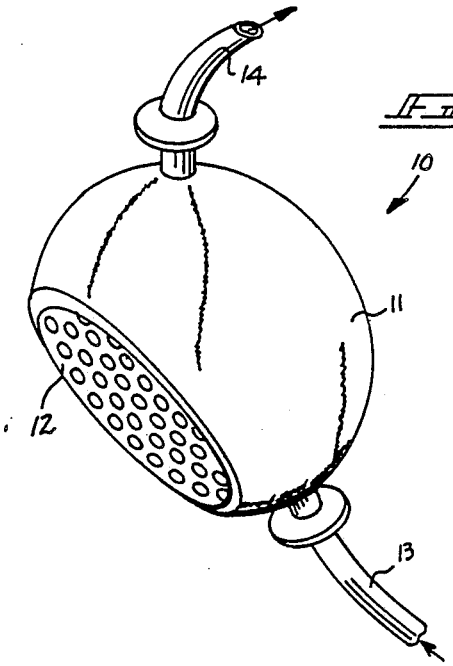
FIG. 2 is an isometric illustration of the instant invention.

With reference now to the drawings, and in particular to FIGS. 1 to 8 thereof, a new and improved hair rinsing device embodying the principles and concepts of the present invention and generally designated by the reference numeral 10 will be described.

More specifically, the hair rinsing device 10 of the instant invention essentially comprises a flexible outer fluid impermeable convex convex 11 selectively securable to an inner fluid impermeable convex cover 12 of flexible construction, wherein the inner and outer covers are securable relative to one another about their opening perimeters to enable cleaning and maintenance of the covers. FIG. 1 is illustrative of a typical prior art device wherein a helmet-like device is provided with a plurality of openings therethrough to enable a spray member, such as a water spray device, to be directed &through one of the apertures, as desired.

The outer cover 11 includes an inlet hose 13 securable to a fitting of the outer cover with an outlet hose 14 enabling the removal of excess rinsing fluid from within the confines of the chamber formed between the inner and outer covers 11 and 12. The inner cover 12 includes a matrix of through-extending apertures is formed throughout the surface of the inner cover, and wherein the inner cover 12 terminates in an elastomeric band 16 to enhance securement of the cover about an individual's head region adjacent the hair portion defined by an individual. It is understood that the outer cover is defined by a central opening substantially equal to a further central openIng defined by the inner cover 12 to enable the covers to be adhereably secured together, as illustrated In FIG. 4, about their respective perimeters defining their respective central openings. The elastomeric band 16 includes a flexible sheath 17 with an elastomeric core 18 captured therewithin, wherein the elastomeric core and flexible sheath 17, as well as the elastomeric band 16, are of a continuous construction about the perimeter of the opening of the inner cover 12. The elastomeric band 16 further includes a non-elastic inner core rim 19 laminated in overlying relationship relative to the flexible sheath 17 and includes an outwardly extending continuous tongue 20 of generally trapezoidal configuration positioning above an upper surface of the rim 19 receivable within a complementary shaped continuous groove 21 formed within the non-elastic outer cover rIm 22 of the outer cover 11. FIG. 4 is illustrative of the inner and outer covers 11 and 12 respectively and the water chamber 31 defined by the securement of the inner and outer covers together. The chamber 31 enables the directing of water therewithin outwardly through the various apertures 15 onto a hair portion of an individual for rinsing thereof and subsequently directing of such fluid through the outlet hose 14.

Figure 5:
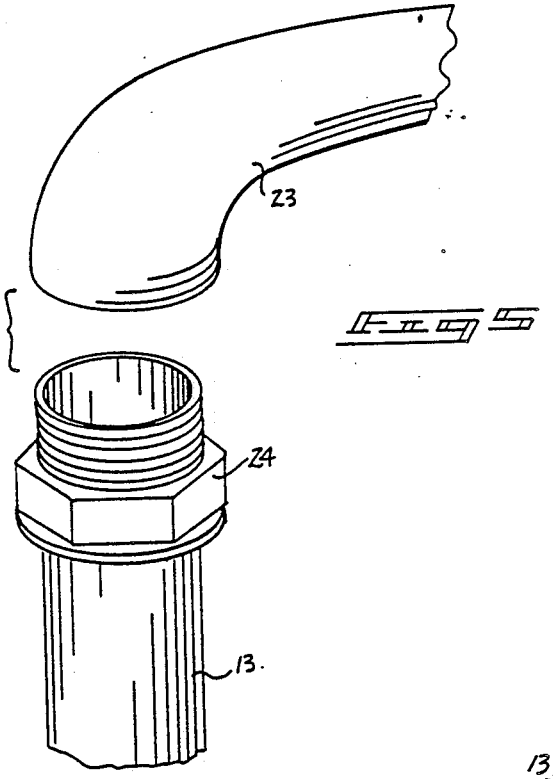
FIG. 5 is an isometric illustration of a fluid hose utilized by the instant invention coupled to a typical water faucet.
Figure 6:
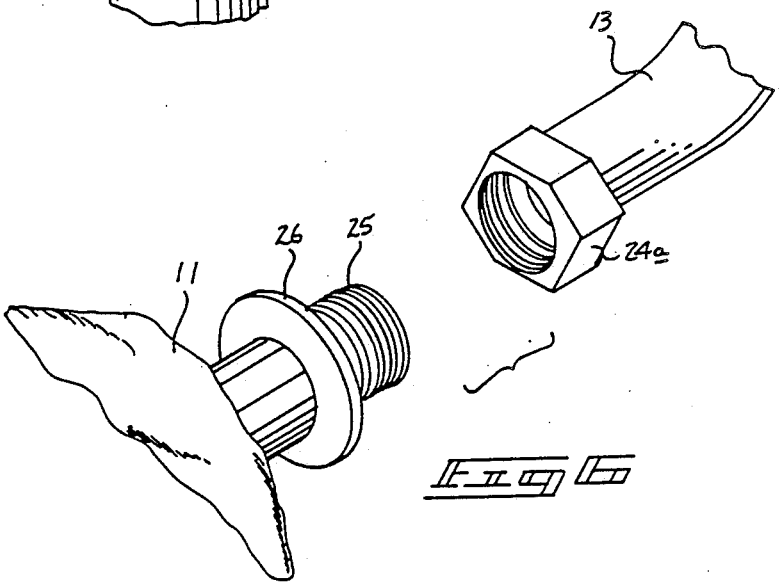
FIG. 6 is an isometric illustration of an inlet hose utilized by the instant invention securable to the outer cover of the instant invention.
Figures 8B, 11:
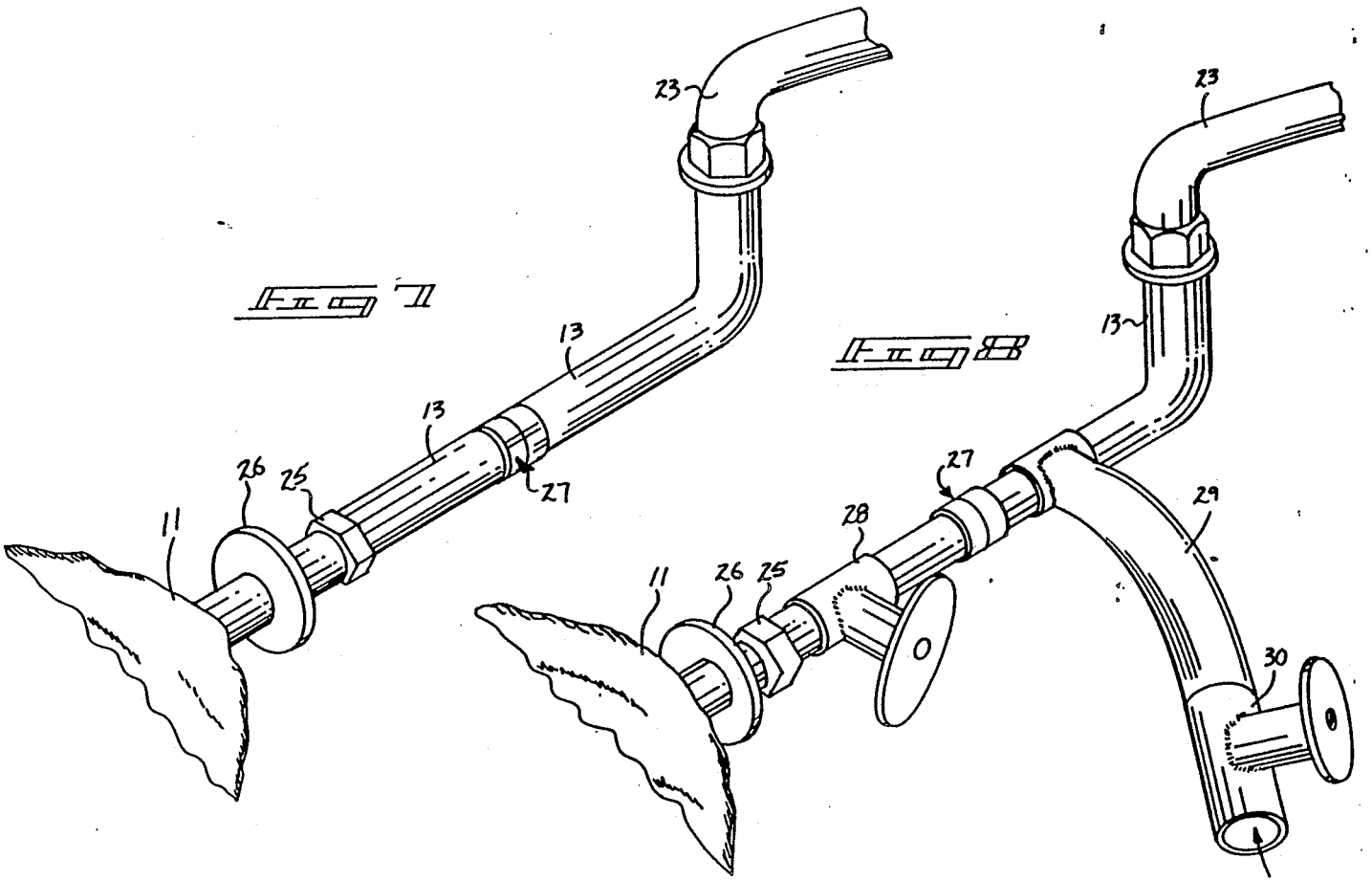
FIG. 8 is an isometric illustration of a modified inlet hose of the instant invention utilizing valving to enable a plurality of fluid sources to be utilized.

FIG. 5 is illustrative of the inlet hose 13 and its first hose connection 24 for securement to a conventional plumbing faucet 23. The other end of the inlet hose 13 includes a second hose connection 24*a* engageable with the outer covers coupling 25 that includes an annular shield 2G thereabout to deflect spray that may result from an incomplete coupling of the securement of the second hose connection 24*a* to the outer cover coupling 25. FIG. 7 illustrates the use of a swivel connection 27 between a plurality of segments of the inlet hose 13 to prevent kinking and tWisting of the inlet hose 13 during use of the device. The swivel connection 25 is of construction utilizing a plurality of relatively pivotal connections enabling a directing of fluid therethrough. The FIG. 8 illustrates the optional use of a first shut-off valve 2B to enable convenient and selective terminating of fluid enterIng the device through the outer cover coupling 25 with use of a further inlet hose 29 that enables the mixing of water from various fluid sources, such as a hot and cold water source, to precisely meter the temperature directed interiorly of the water chamber 1 with a second shut-off valve 30 positioned and aligned with the further inlet hose 29 between a junction formed between &he further inlet hose 20 and a further plumbing faucet-type fixture {not illustrated).

As to the manner of usage and operation of the instant invention, the same should he apparent from the above disclosure, and accordingly no further discussion relative to the manner of usage and operation of the instant invention shall be provided.

With respect to the above description then, it is to be realized that the optimum dimensional relationship for the of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered is illustrative only of the principles of the invention. Further, since numerous modifications and changes will readily occur to those skilled in the art, it is not desired to limit the invention to the exact construction and operation shown and described, and accordingly, all suitable modifications and equivalents may he resorted to, falling withIn the scope of the invention.

What is claimed as being new and desired to be protected by LETTERS PATENT of the United States is as follows:

1. A hair rinsing device comprising, a flexible convex outer cover including a central opening defined by a first perimeter rim wherein the outer cover is selectively securable to a flexible convex inner covering including a further central opening defined by a second perimeter rim, and the outer cover formed of a fluid impermeable material with the inner cover formed of a fluid impermeable material and wherein the inner cover further includes a matrix of fluid openings formed in the inner cover spaced from the second rim, and a fluid inlet integrally secured to the outer cover to receive fluid and direct the fluid to the fluid openings of the inner cover, and including a water chamber defined between the inner and outer cover, wherein the inner and outer cover are secured together, and wherein the first rim includes a continuous trapezoidal channel formed within a bottom surface of the first rim, and the second rim includes a trapezoidal rib extending upwardly and orthogonally relative to an upper surface of the second rim to enable the trapezoidal channel to receive the trapezoidal rib for securement of the first and second covers together.

2. A hair rinsing device as set forth in claim 1 wherein the second rim further includes a continuous elastomeric sheath laminated to a bottom surface of the second rim, and the sheath further including an elastomeric core captured therein surrounded by the elastomeric sheath.

3. A hair rinsing device as set forth in claim 2 wherein the fluid openings are defIned by a matrix of through-extending apertures formed throuGhout the inner cover spaced from the second rim.

4. A hair rinsing device as set forth in claim 3 wherein the outer cover further includes an outlet hose spaced from the fluid inlet and operably associated with the water chamber to direct excess fluid received within the fluid chamber exteriorly of the fluid chamber through the outlet hose.

5. A haIr rInsIng devIce as set forth in claim 4 wherein the fluid inlet includes a connector member to releasably secure the inlet hose thereto, the inlet hose including a further connector for securement to a plumbing faucet.

6. A hair rinsing device as se& forth in claim 5 wherein the inlet hose includes a swivel connector formed medially thereof to avoid kinkling and twistIng of the inlet hose.

7. A hair rinsing device as set forth in claim 5 wherein the inlet hose further includes a shut-off valve therein to selectively discontinue flow to the fluid inlet of the outer cover.

8. A hair rinsing device as set forth in claim 7 further including a further inlet hose in fluid communication with the inlet hose, and wherein the further inlet hose includes a further shut-off valve.

* * * * *